US011527368B2

(12) United States Patent
Kechroud et al.

(10) Patent No.: US 11,527,368 B2
(45) **Date of Patent: *Dec. 13, 2022**

(54) INERTIAL SHORT-CIRCUIT AND SEISMIC HOOK

(71) Applicant: General Electric Technology GmbH, Baden (CH)

(72) Inventors: Riyad Kechroud, La Prairie (CA); Clement Rollier, Hudson (CA); Pascal Babin, St.-Jacques-le-Mineur (CA)

(73) Assignee: General Electric Technology GmbH, Baden (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/065,379

(22) Filed: Oct. 7, 2020

(65) Prior Publication Data

US 2021/0027957 A1 Jan. 28, 2021

Related U.S. Application Data

(63) Continuation of application No. 16/249,795, filed on Jan. 16, 2019, now Pat. No. 10,892,114.

(51) Int. Cl.
*H01H 3/54* (2006.01)
*H01H 1/36* (2006.01)

(52) U.S. Cl.
CPC ..... *H01H 3/54* (2013.01); *H01H 1/36* (2013.01)

(58) Field of Classification Search
CPC ..... H01H 3/54; H01H 1/36; H01H 31/16; H01H 3/20
USPC ..... 200/252, 48 R, 327
See application file for complete search history.

(56) References Cited

U.S. PATENT DOCUMENTS

| | | | | |
|---|---|---|---|---|
| 3,634,634 | A | 1/1972 | Cole | |
| 8,138,861 | B2 | 3/2012 | Krieger et al. | |
| 9,208,976 | B2 | 12/2015 | Girlando et al. | |
| 10,892,114 | B2 * | 1/2021 | Kechroud | H01H 1/44 |
| 2010/0288610 | A1 * | 11/2010 | Krieger | H01H 1/50 200/327 |
| 2013/0118874 | A1 * | 5/2013 | Girlando | H01H 31/16 200/48 R |

FOREIGN PATENT DOCUMENTS

| | | | |
|---|---|---|---|
| EP | 2 228 810 | A2 | 9/2010 |
| WO | 2012/007243 | A1 | 1/2012 |

OTHER PUBLICATIONS

Search Report & Written Opinion issued in PCT/EP2020/051021, dated Mar. 11, 2020, 12 pages.

* cited by examiner

*Primary Examiner* — Edwin A. Leon
*Assistant Examiner* — Iman Malakooti
(74) *Attorney, Agent, or Firm* — Eversheds Sutherland (US) LLP

(57) ABSTRACT

Embodiments of the disclosure can include an inertial short-circuit and seismic hook for an electrical equipment disconnect switch.

13 Claims, 12 Drawing Sheets

INERTIAL SHORT-CIRCUIT AND SEISMIC HOOK

CROSS-REFERENCE TO RELATED APPLICATIONS

This application is a Continuation of U.S. patent application Ser. No. 16/249,795, filed Jan. 16, 2019, the contents of which are incorporated by reference.

TECHNICAL FIELD

The disclosure relates to disconnect switches, and in particular to systems and methods for providing an inertial short-circuit and seismic hook.

BACKGROUND

Conventional power substation equipment, such as low and high voltage equipment, is oftentimes elevated above the ground using support structures which keep the equipment suitably elevated to protect the equipment and personnel. In seismically active regions, the power substation equipment may be disconnected in response to an unexpected seismic event, and as a result could damage the electrical components of the power substation equipment, and endanger the lives of personnel.

BRIEF DESCRIPTION OF THE DISCLOSURE

Some or all of the above needs and/or problems may be addressed by certain embodiments of the disclosure. Certain embodiments can include an inertial short-circuit and seismic hook for an electrical equipment disconnect switch.

According to one embodiment, a circuit disconnect apparatus can be provided. The circuit disconnect apparatus can include a catch device mounted to a first conductor of a circuit, wherein the catch device is connected to the first conductor such that it freely moves from a first position to a second position along a predetermined first path for a speed of movement below a limiting speed, and that the catch device moves along a predetermined second path for a speed of movement above the limiting speed. When moving along the predetermined second path, the catch device engages a stop device, thereby preventing the circuit disconnect apparatus from disconnecting.

In at least one embodiment, the catch device can include a first mass guided along the predetermined first path, having a curved path, by a guiding force, and when an inertial force of the catch device moving along the curved path exceeds a guiding force, the catch device deviates from the curved path and follows the predetermined second path.

In at least one embodiment, the guiding force can include at least one of the following: gravity, a controlled force, a controlled and intended force, and a spring force.

In at least one embodiment, the catch device includes a pin, and the stop device includes a hook portion of the C-shaped plate including an L-shaped body with a lip.

According to another embodiment, a method for using a circuit disconnect apparatus can be provided. The method can include manipulating a catch device mounted to a first conductor of a circuit, wherein the catch device is connected to the first conductor, from a first position to a second position along a predetermined first path for a speed of movement below a limiting speed. The method can also include manipulating the catch device moves along a predetermined second path for a speed of movement above the limiting speed. The method can further include, when moving along the predetermined second path, engaging a stop device by the catch device, thereby preventing the circuit disconnect apparatus from disconnecting.

In at least one embodiment, the catch device includes a first mass guided along the predetermined first path, including a curved path, by a guiding force, and the method further includes, when an inertial force of the catch device moving along the curved path exceeds a guiding force, deviating from the curved path, wherein the catch device follows the predetermined second path.

In at least one embodiment, the guiding force can include at least one of the following: gravity, a controlled force, a controlled and intended force, and a spring force.

According to one embodiment, a circuit disconnect apparatus is disclosed. The circuit disconnect apparatus can include a movable blade plate mounted to a first conductor of a circuit, wherein the movable blade plate includes a pin mounted to a portion of the movable blade plate. The circuit disconnect apparatus can also include a pivot bar mounted in a stationary position to a second conductor of the circuit. The circuit disconnect apparatus can also include a C-shaped plate mounted to the pivot bar, wherein the C-shaped plate rotates about an axis with respect to the pivot bar, the C-shaped plate having an elongated portion connected to a hook portion with an opening between the elongated portion and the hook portion; wherein when the apparatus is in a closed position, the movable blade plate moves adjacent the C-shape plate, wherein the pin moves within the opening of the C-shaped plate, and the pin is in contact with the C-shaped plate; wherein when an intended disconnect operation is initiated for the apparatus, the movable blade plate is retracted away from the C-shaped plate, wherein the pin moves along the elongated portion until the pin disengages contact with the C-shaped plate and is no longer within the opening of the C-shaped plate; and wherein when an unexpected disconnect event occurs, and the apparatus is in the closed position, the pin is retained within the opening of the C-shaped plate and the pin remains in contact with either the elongated portion or the hook portion of the C-shaped plate.

According to yet another embodiment, a method is disclosed for providing a circuit disconnect apparatus. The method can include providing a movable blade plate mounted to a first conductor of the circuit, wherein the movable blade plate includes a pin mounted to a portion of the movable blade plate. The method can also include providing a pivot bar mounted in a stationary position to a second conductor of the circuit. The method can further include providing a C-shaped plate mounted to the fixed pivot bar, wherein the C-shaped plate rotates about an axis with respect to the pivot bar, the C-shaped plate having an elongated portion connected to a hook portion with an opening between the elongated portion and the hook portion; wherein when the apparatus is in a closed position, the movable blade plate moves adjacent the C-shaped plate, wherein the pin moves within the opening of the C-shaped plate, and the pin is in contact with the C-shaped plate; wherein when a disconnect operation is initiated for the apparatus, the movable blade plate is retracted away from the C-shaped plate, wherein the pin moves along the elongated portion until the pin disengages contact with the C-shaped plate and is no longer within the opening of the C-shaped plate; and wherein when an unexpected disconnect event occurs, and the apparatus is initially in a closed position, the movable pin is retained within the opening of the C-shaped plate and the pin remains in contact with either the elongated portion or the hook portion of the C-shaped plate.

In yet another embodiment, a circuit disconnect apparatus is disclosed. The circuit disconnect apparatus can include a movable blade plate mounted to a first conductor of a circuit, wherein the movable blade plate includes an external surface. The circuit disconnect apparatus can include a connecting device mounted to a second conductor of the circuit. The circuit disconnect apparatus can further include a mechanism operable to provide contact between the movable blade plate and the connecting device when the apparatus is in a closed position; wherein when a disconnect operation is initiated for the apparatus, the movable blade plate is retracted away from the connecting device, wherein the mechanism permits the movable blade plate to retract away from the connecting device until there is no contact between the movable blade plate and the connecting device; and wherein when an unexpected disconnect event occurs, and the apparatus is in a closed position, the mechanism inhibits the movable blade plate from retracting away from the connecting device and maintains contact between the movable blade plate and the connecting device.

In yet another embodiment a method for using a circuit disconnect apparatus is disclosed. The method can include manipulating a movable blade plate mounted to a first conductor of a circuit, wherein the movable blade plate includes a pin mounted to a portion of the movable blade plate, towards a pivot bar mounted in a stationary position to a second conductor of the circuit, wherein a C-shaped plate is mounted to the pivot bar. The method can also include, as the movable blade moves towards the pivot bar, rotating the C-shaped plate about an axis with respect to the pivot bar, the C-shaped plate having an elongated portion connected to a hook portion with an opening between the elongated portion and the hook portion. The method can further include, when the apparatus is in a closed position, maintaining contact between the movable blade plate and the C-shape plate, wherein the pin moves within the opening of the C-shaped plate, and the pin is in contact with the C-shaped plate. The method can also include, when an intended disconnect operation is initiated for the apparatus, retracting the movable blade plate away from the C-shaped plate, wherein the pin moves along the elongated portion until the pin disengages contact with the C-shaped plate and is no longer within the opening of the C-shaped plate. The method can further include, when an unexpected disconnect event occurs and the apparatus is in the closed position, retaining the pin within the opening of the C-shaped plate and the pin remains in contact with either the elongated portion or the hook portion of the C-shaped plate.

Other embodiments, systems, methods, apparatuses, aspects, and features of the disclosure will become apparent to those skilled in the art from the following detailed description, the accompanying drawings, and the appended claims.

BRIEF DESCRIPTION OF THE FIGURES

The detailed description is set forth with reference to the accompanying drawings, which are not necessarily drawn to scale. The use of the same reference numbers in different figures indicates similar or identical items.

Certain implementations will now be described more fully below with reference to the accompanying drawings, in which various implementations and/or aspects are shown. Various aspects may, however, be implemented in many different forms and should not be construed as limited to the implementations set forth herein. Like numbers refer to like elements throughout. The following detailed description includes references to the accompanying drawings, which form part of the detailed description. The drawings depict illustrations, in accordance with example embodiments. These example embodiments, which are also referred to herein as "examples," are described in enough detail to enable those skilled in the art to practice the present subject matter. The example embodiments may be combined, other embodiments may be utilized, or structural, logical, and electrical changes may be made, without departing from the scope of the claimed subject matter. The following detailed description is, therefore, not to be taken in a limiting sense, and the scope is defined by the appended claims and their equivalents.

DETAILED DESCRIPTION

Illustrative embodiments will now be described more fully hereinafter with reference to the accompanying drawings, in which some, but not all embodiments of the disclosure are shown. The disclosure may be embodied in many different forms and should not be construed as limited to the embodiments set forth herein; rather, these embodiments are provided so that this disclosure will satisfy applicable legal requirements.

Illustrated embodiments herein are directed to, among other things, systems and methods for providing an inertial short circuit and seismic hook. Certain embodiments are directed to an inertial short-circuit and seismic hook for an electrical equipment disconnect switch. Certain embodiments are directed to a hook apparatus for a disconnect switch utilized in low voltage and/or high voltage electrical equipment. Technical effects of certain embodiments of the disclosure may include providing a switching device that can be disconnected when an intended disconnect event occurs, and that can, when an unexpected disconnect event occurs, maintain an electrical connection. Further technical effects of certain embodiments of the disclosure may allow certain low and/or high voltage electrical equipment to withstand certain seismic stresses and continue operating without interruption during and/or after a seismic event, unexpected disconnect event, or an unintended disconnect event, or short circuit. Certain technical effects of certain embodiments of the disclosure may also provide increased reliability in operating low and/or high voltage electrical equipment during and/or after a seismic event, unexpected disconnect event, an unintended disconnect event, or short circuit.

Figure 1:
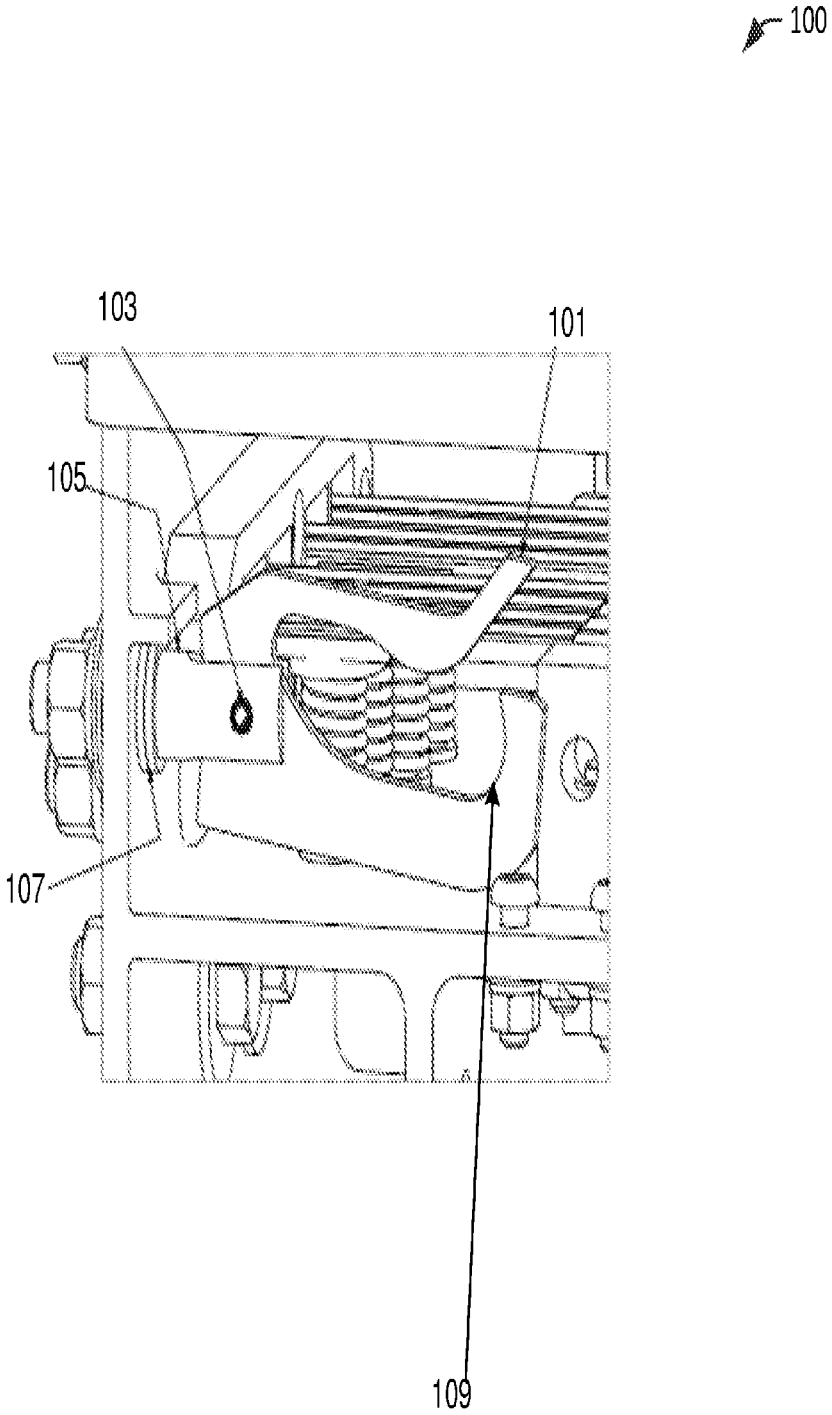
FIG. 1 depicts a side perspective view of an example seismic hook, according to one example embodiment.

FIG. 1 depicts a side perspective view of an example stop device such as a C-shaped plate including an L-shaped body with a lip, according to one example embodiment. The stop device may be a seismic hook 100, and can be a C-shaped plate mounted to a pivot bar 105 via a pin 103. Seismic hook 100 can rotate about an axis with respect to the pivot bar 105. Seismic hook 100 can have an elongated portion 101 connected to a hook portion 109 with an opening between the elongated portion and the hook portion. There may be one or more washers 107 mounting the pivot bar to a stationary position associated with a conductor that is a guide of a jaw part of a circuit.

Figure 2:
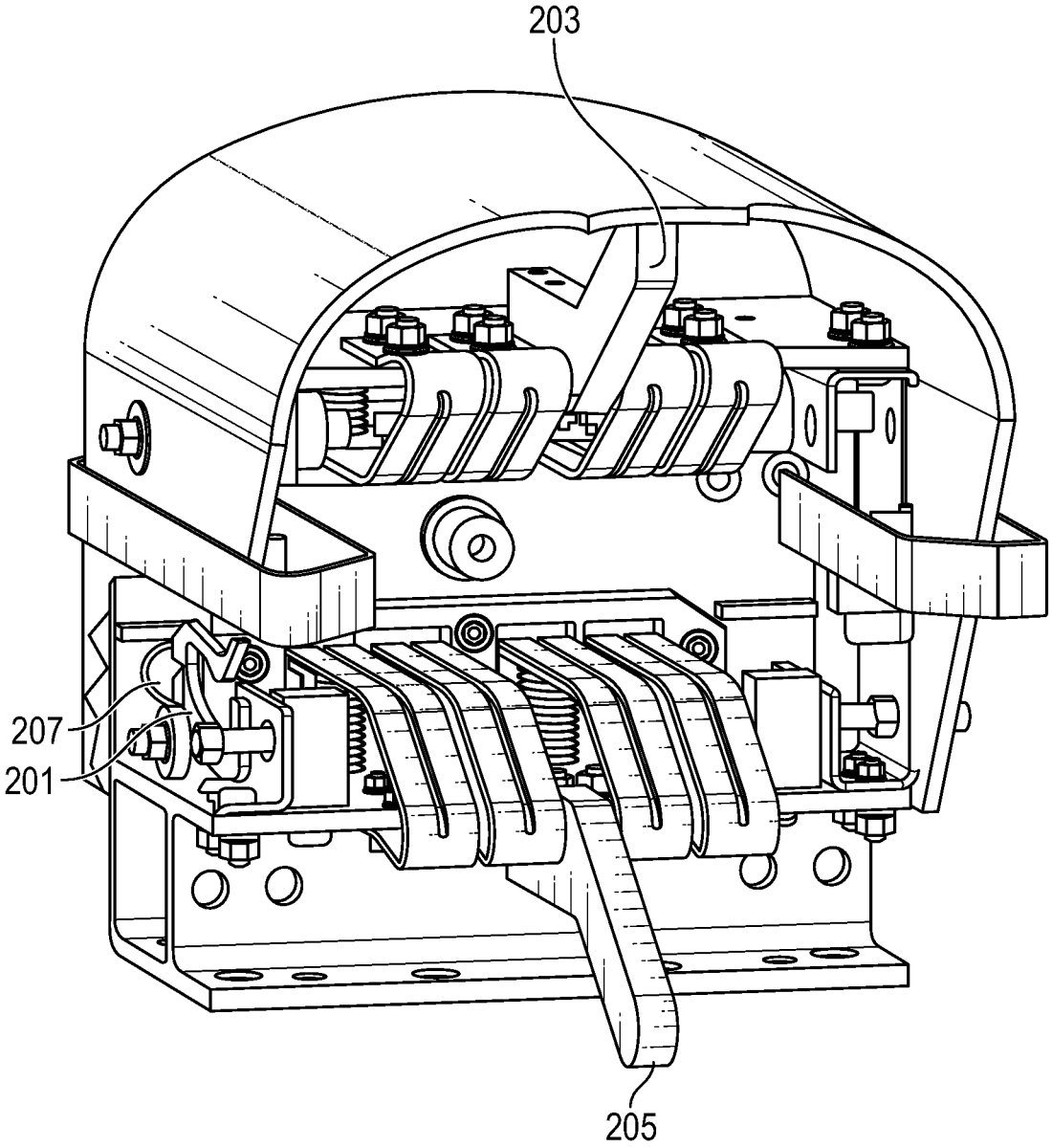
FIG. 2 depicts an inward facing perspective view of an example jaw part conductor, according to one example embodiment.

FIG. 2 depicts an inward facing perspective view of an example jaw part conductor, according to one example embodiment. The jaw part conductor can have a stop device connected to it. The stop device can be a seismic hook 201 can be connected to a pivot bar 207. Conductors 203 and 205 can be guides of the jaw part of the circuit. A catch device such as a movable blade plate (not shown), along with a pin, may have two conductors, one on either side, and may move into the open area between the conductor 203 and the conductor 205 thereby closing a circuit between the jaw part of the circuit, and the pivot part of the circuit.

Figure 3:
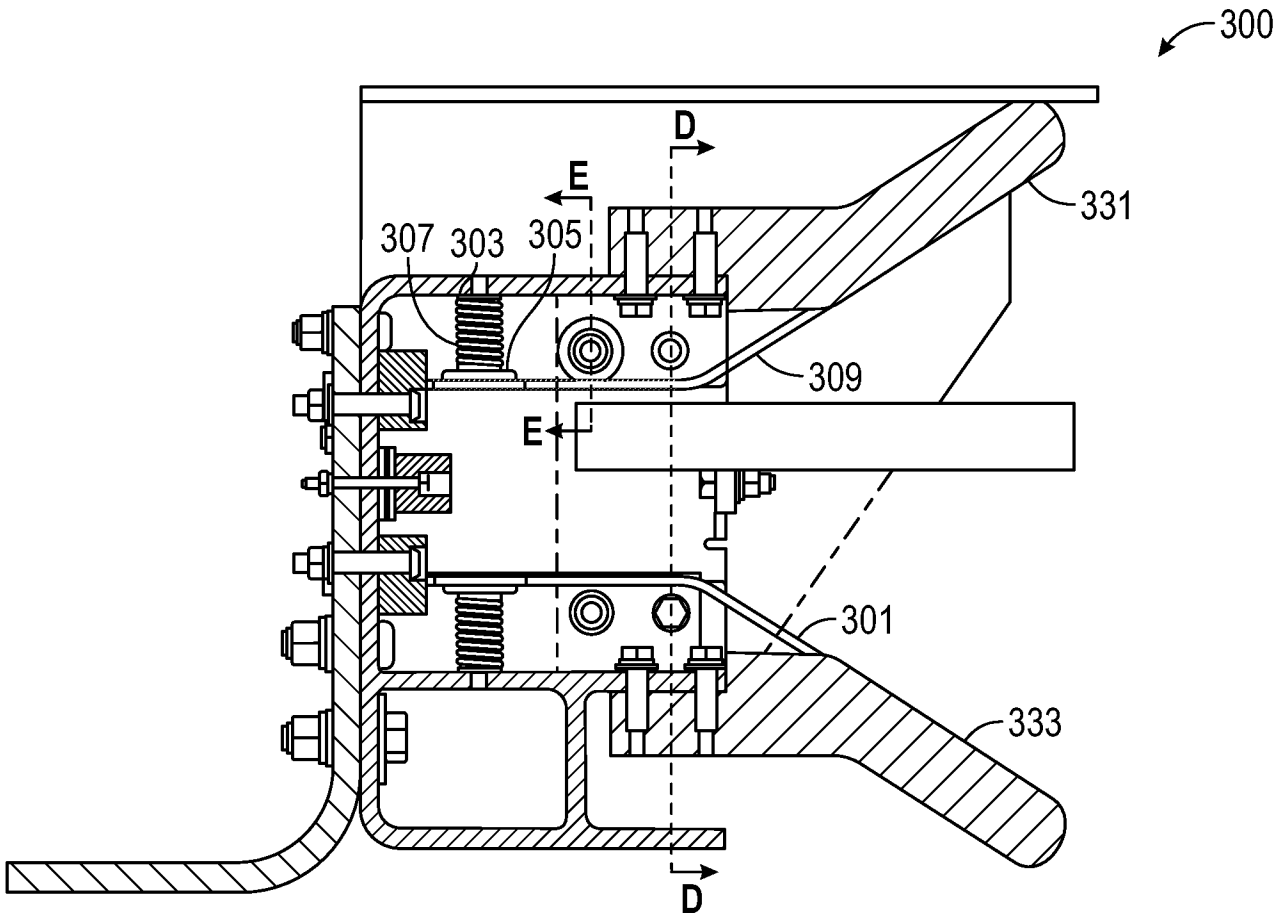
FIG. 3 depicts a cutaway side perspective view of an example jaw part conductor, according to one example embodiment.

FIG. 3 depicts a cutaway side perspective view of an example jaw part conductor, according to one example embodiment. Jaw part conductor 300 can include a conductor 301 and a conductor 309. The conductor 301 and the conductor 309 can be guides of the jaw part of the circuit. Jaw part conductor 300 can include a first contact including of contact parts 303, 305, and 307. Contact parts 305 and 307 can be responsible for completing a circuit between equipment connected to the jaw part of the circuit and the pivot part of the circuit. When the conductors on the catch device come into contact with the conductors 301 and 309, current may flow through contact part 303 through contact parts 307 and 305 to complete the circuit between the equipment connected to the jaw part of the circuit and the pivot part of the circuit. The catch device can include a movable blade plate and a pin. The jaw conductor 300 can include a guide 331 and a guide 333. The guide 331 and the guide 333 may guide a movable blade plate to the conductor 301 and the conductor 309.

In some embodiments, certain portions of a jaw part conductor may include non-conductive portions that still serve as guides of the jaw part of the circuit. That is, when the catch device comes into contact with certain non-conductive portions of the jaw part conductor 300, the catch device does not complete the circuit until the catch device comes into contact with conductive portions of the jaw part conductor 300.

Figure 4:
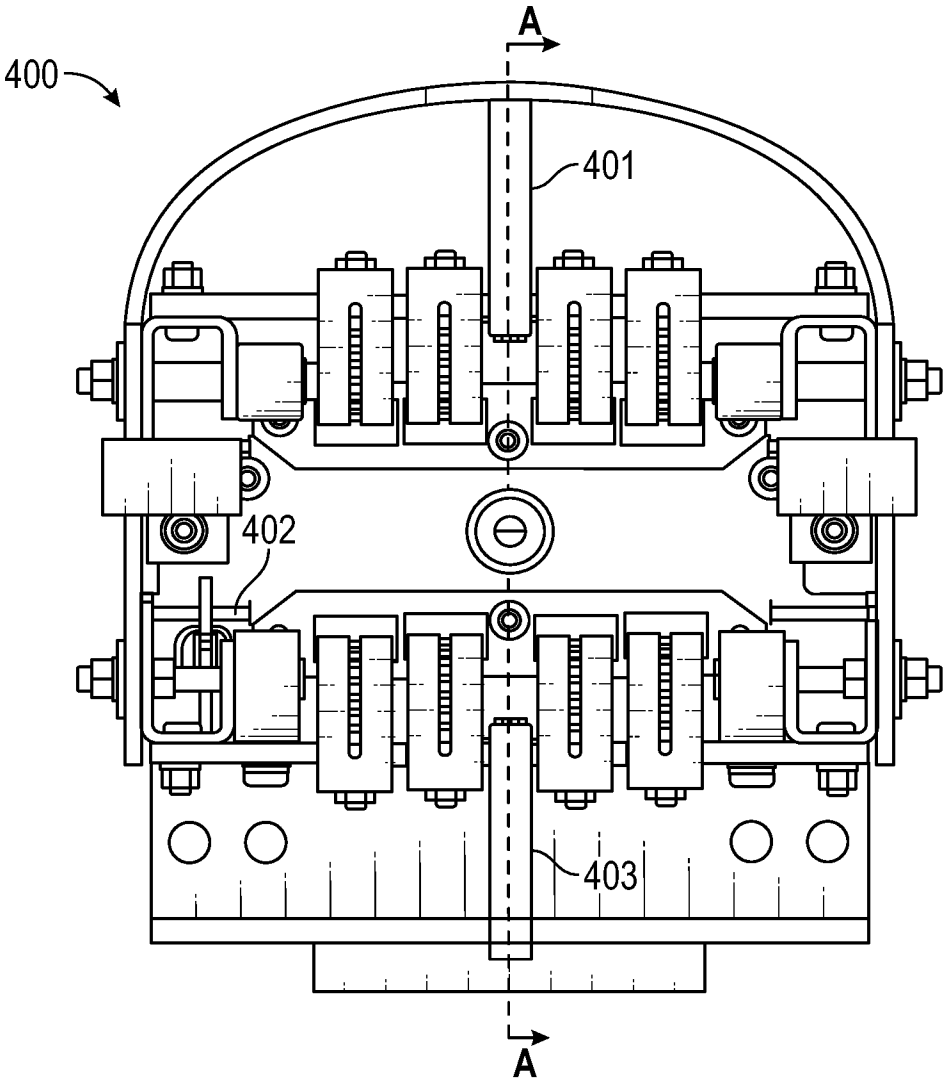
FIG. 4 depicts a front facing perspective view of an example jaw part conductor, according to one example embodiment.

FIG. 4 depicts a front facing perspective view of an example jaw part conductor, according to one example embodiment. Jaw part conductor 400 can include a conductor 401, a conductor 403, and a stop device such as a seismic hook 402. The conductor 401 and the conductor 403 are front facing views of the conductors 203 and 205 and the conductors 309 and 301 respectively.

Figure 5:
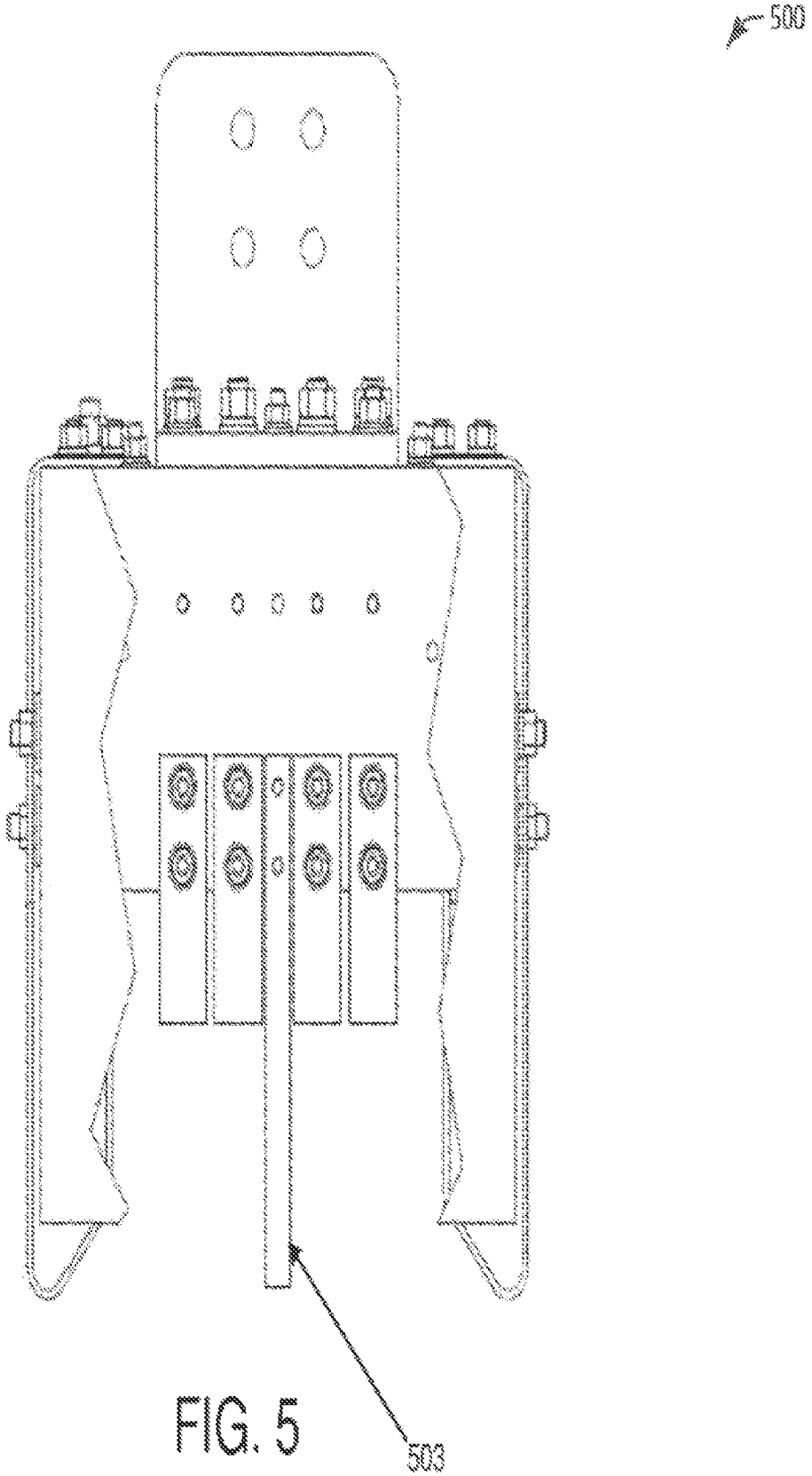
FIG. 5 depicts an overhead cutaway perspective view of an example jaw part conductor, according to one example embodiment.

FIG. 5 depicts an overhead cutaway perspective view of an example jaw part conductor, according to one example embodiment. Jaw part conductor 500 can include one or more conductors 503. Although not shown, conductors 503 can correspond to an overhead perspective of conductors 203 and 205, 309 and 301, and 401, and 403.

Figure 6A:
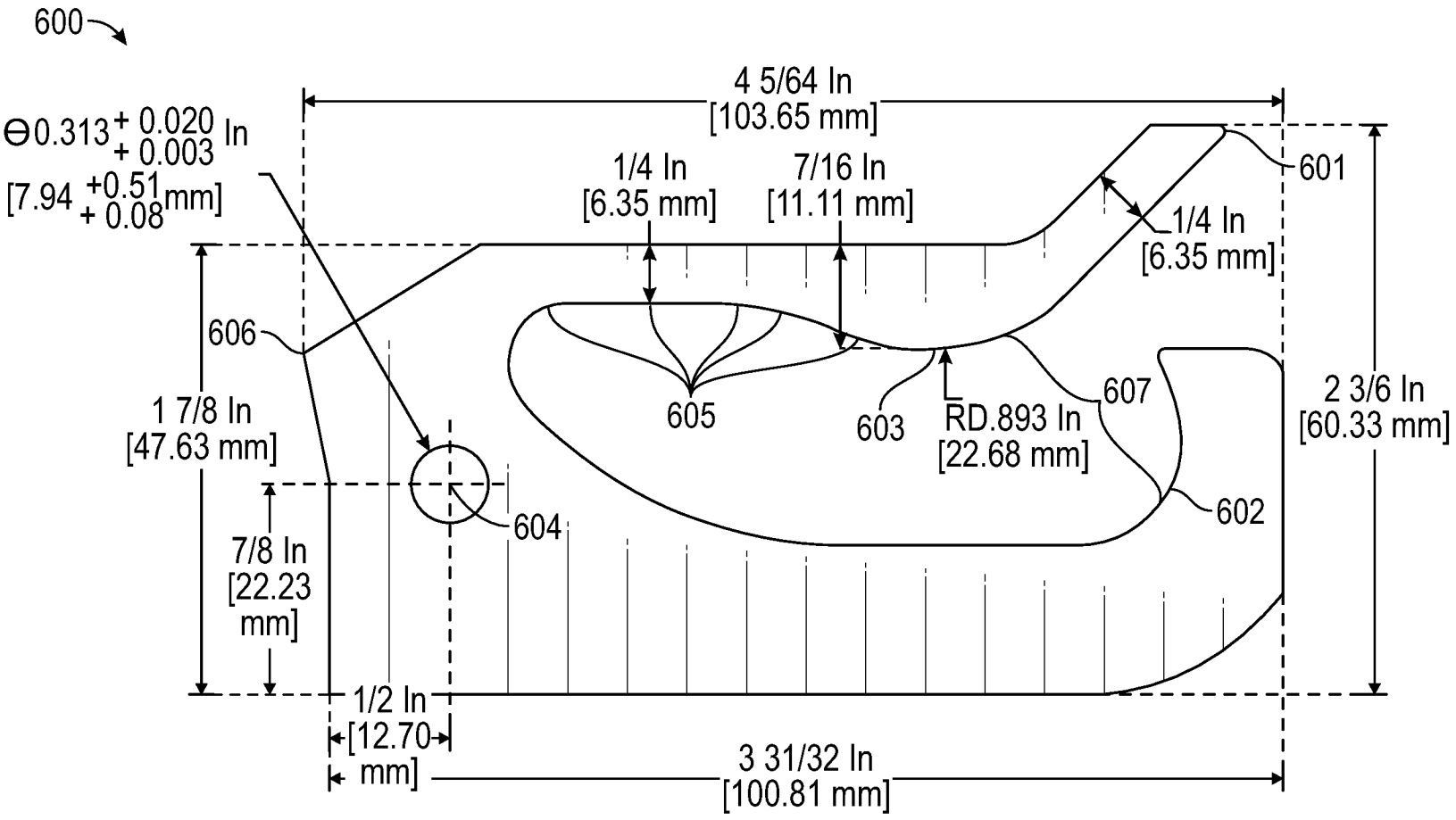
FIG. 6A depicts a side perspective view of an example seismic hook, according to one example embodiment.

FIG. 6A depicts a side perspective view of an example stop device including a seismic hook portion of a C-shaped plate including an L-shaped body with a lip, according to one example embodiment. The stop device can be a seismic hook 600 can be machined in such a way to have the shape as shown in FIG. 6A. Seismic hook 600 can be a C-shaped plate that rotates about an axis 604 with respect to a pivot bar (e.g., pivot bar 105). Seismic hook 600 can be machined with a suitable shape to control a response to an unexpected or intended disconnect event, such as a disconnection between the jaw part of the circuit and the pivot part of the circuit. The catch device described above includes a pin that moves along the inner portion of seismic hook 600 during a connect operation (closing of a circuit between the jaw part of the circuit and the pivot part of the circuit) or an intended and/or unexpected disconnect operation (opening of a circuit between the jaw part of the circuit and the pivot part of the circuit). The catch device can freely move from a first position to a second position along a predetermined first path at a speed of movement below a limiting speed. The catch device can move along a predetermined second path for a speed of movement above the limiting speed. As the catch device moves along the predetermined second path, the catch device engages a stop device (not shown), thereby preventing the circuit disconnect apparatus from disconnecting.

The pin, or first mass, can be guided along the predetermined first path, including a curved path, by a guiding force, and when the inertial force, of the catch device moving along the curved path, exceeds a guiding force, the catch device deviates from the curved path and follows the predetermined second path. The guiding force can be gravity, a controlled force, a controlled and intended force, and/or a spring force. The inertial force can include a seismic event, an unexpected disconnect event, or an unintended disconnect event. A spring force can be generated by a spring, a retractable roller with a spring, or a cable or wire in combination with a spring and/or a retractable roller with a spring.

Prior to a disconnect operation, the pin may be positioned in any one of the locations 605 along the inside of the elongated part 601, and when a disconnect operation is initiated may traverse the inside of elongated part 601 toward curve 603. In one embodiment, called a slow or normal disconnect operation, the pin may travel at a certain velocity such that the pin can traverse the entire inside of the elongated part 601. When the pin travels from any of the locations 605 toward the end of the elongated part 601 the pin can traverse the curve 603 as the pin travels from any of the locations 605 to the end of the elongated part 601. In another embodiment, called a fast or unexpected disconnect, the pin may travel at a velocity that is faster than the velocity that the pin can travel in a normal disconnect operation. As a result, when the pin travels away from any of the locations 605, the pin can traverse the curve 603 and move across the opening 607 and strike an L-shaped body 602. This can prevent or otherwise inhibit the conductors on the catch device from disconnecting from the conductors that are guides in the jaw part of the circuit in the event of an unexpected disconnect event such as a seismic event, unexpected disconnect event, an unintended disconnect event, or short circuit. The curve 603 may be machined in such a way that the internal concave curvature modifies the trajectory of the pin during high speed, and prevents or otherwise inhibits the pin from exiting through the L-shaped body 602 (the retaining part of the hook).

It should be noted that the seismic hook 600 may not rotate 360 degrees. Once a disconnect operation is initiated and later ended, the seismic hook 600 should return to its initial position (as shown in FIG. 6A) for the next operation closing. In certain embodiments, in order to prevent a full 360 degree rotation of the seismic hook 600, the hook 600 can have a backing 606 that may come into contact with a ledge just above the pivot bar of the jaw part of the circuit.

Figure 6B:
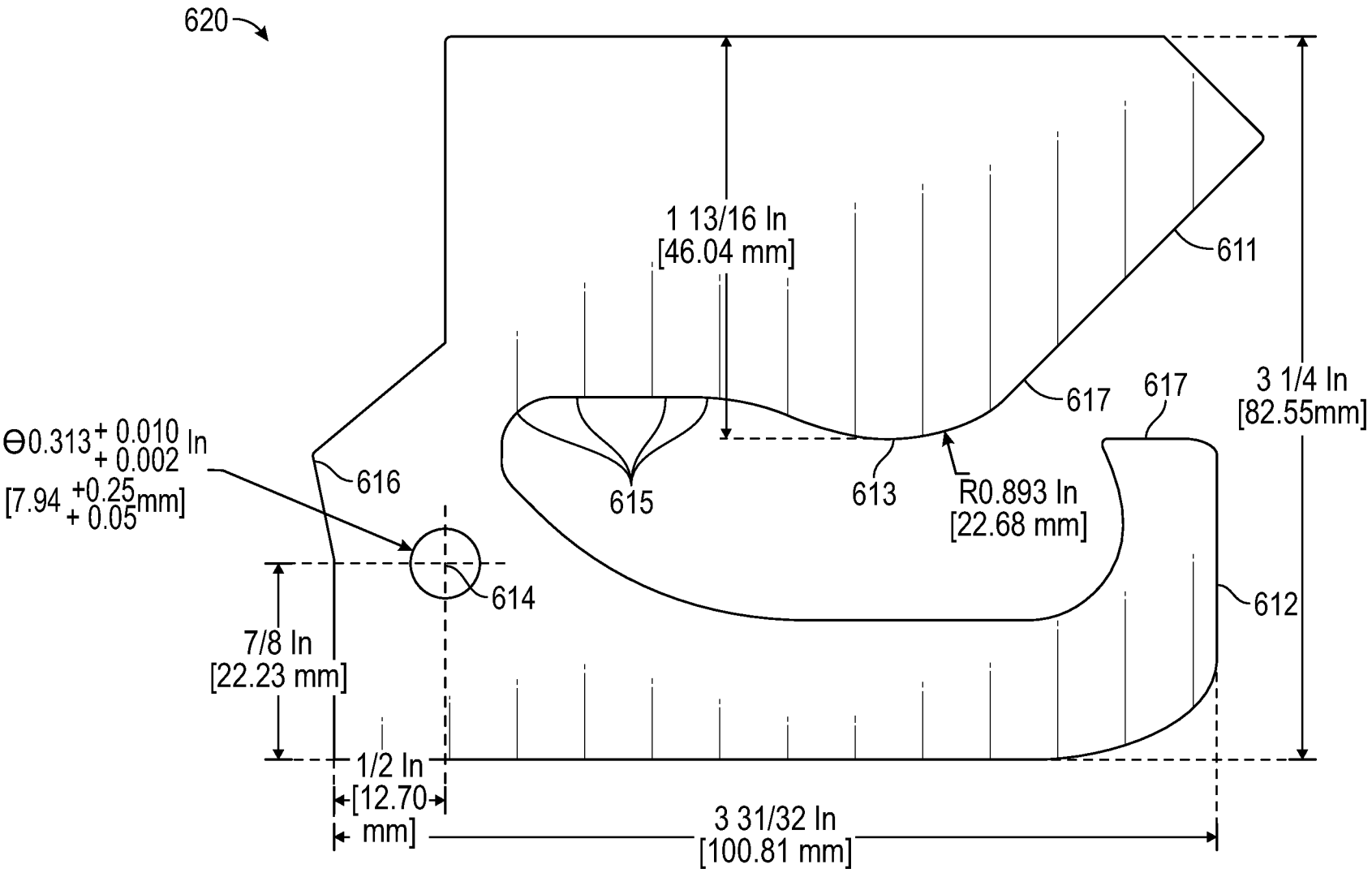
FIG. 6B depicts a side perspective view of another example seismic hook, according to one example embodiment.

FIG. 6B depicts a side perspective view of another example stop device including a seismic hook portion of a C-shaped plate including an L-shaped body with a lip, according to one example embodiment. The stop device can be a seismic hook 620 can be machined in such a way to have the shape presented in FIG. 6B. Seismic hook 620 can be a C-shaped plate that rotates about an axis 614 with respect to a pivot bar (e.g., pivot bar 105). Seismic hook 620 can be machined to have this shape to suitably control a response to an unexpected or intended disconnect event, such as a disconnection between the jaw part of the circuit and the pivot part of the circuit. The catch device described above include a pin that moves along the inner portion of seismic hook 620 during a connect operation (closing of a circuit between the jaw part of the circuit and the pivot part of the circuit) or a disconnect operation (opening of a circuit between the jaw part of the circuit and the pivot part of the circuit).

Prior to a disconnect operation the pin may be positioned in any one of the locations 615 along the inside of the elongated part 611, and when a disconnect operation is initiated may traverse the inside of elongated part 611 toward curve 613. In one embodiment, called a slow or normal disconnect operation, the pin may travel at a certain velocity such that the pin can traverse the entire inside of the elongated part 611. When the pin travels from any of the locations 615 toward the end of the elongated part 601 the pin can traverse the curve 613 as it travels from any of the locations 615 to the end of the elongated part 611. In another embodiment, called a fast or unexpected disconnect, the pin may travel at a velocity that is faster than the velocity that the pin can travel in a normal disconnect operation. As a result, when the pin travels away from any of the locations 615, the pin can traverse the curve 613 and move across the opening 617 and strike an L-shaped body 612. This can prevent or otherwise inhibit the conductors on the catch device from disconnecting from the conductors in the jaw part of the circuit in the event of an unexpected disconnect event or an unintended disconnect event, such as a seismic event or short circuit. The curve 613 may be machined in such a way that the internal concave curvature modifies the trajectory of the pin during high speed, and prevents or otherwise inhibits the pin from exiting through the L-shaped body 612 (the retaining part of the hook).

It should be noted that, in certain embodiments, the seismic hook 620 does not rotate 360 degrees. Once a disconnect operation is initiated and later ended, the seismic hook 620 should return to its initial position (as shown in FIG. 6B) for the next operation closing. In order to prevent a full 360 degree rotation of the seismic hook 620, the hook 620 can have a backing 616 that may come into contact with a ledge just above the pivot bar of the jaw part of the circuit.

The difference between the seismic hook 600 and the seismic hook 620 may be the dimensions of the various seismic hooks. The elongated part 611 is wider than the elongated part 601 thereby making the entire width of the seismic hook 620 wider and heavier because more material is used in machining the seismic hook 620. By changing the weight, the behavior of the pin as the pin traverses the inside of the elongated part 611 during shock, seismic event, unexpected disconnect event, unintended disconnect event, or short circuit will be different than the behavior of the pin as the pin traverses the elongated part 601. For instance, because of the downward force exerted by the additional weight provided by the wider elongated part 611, the pin may traverse the inside of the elongated part 611 at a slower velocity as compared to the velocity of a pin traversing the inside of the elongated part 601. In some embodiments, a hook can be machined to be effective for a specific harmful frequency which may cause a disconnect between the conductors that are a guide in the jaw part of the circuit and the conductors on the movable blade part.

Figure 7:
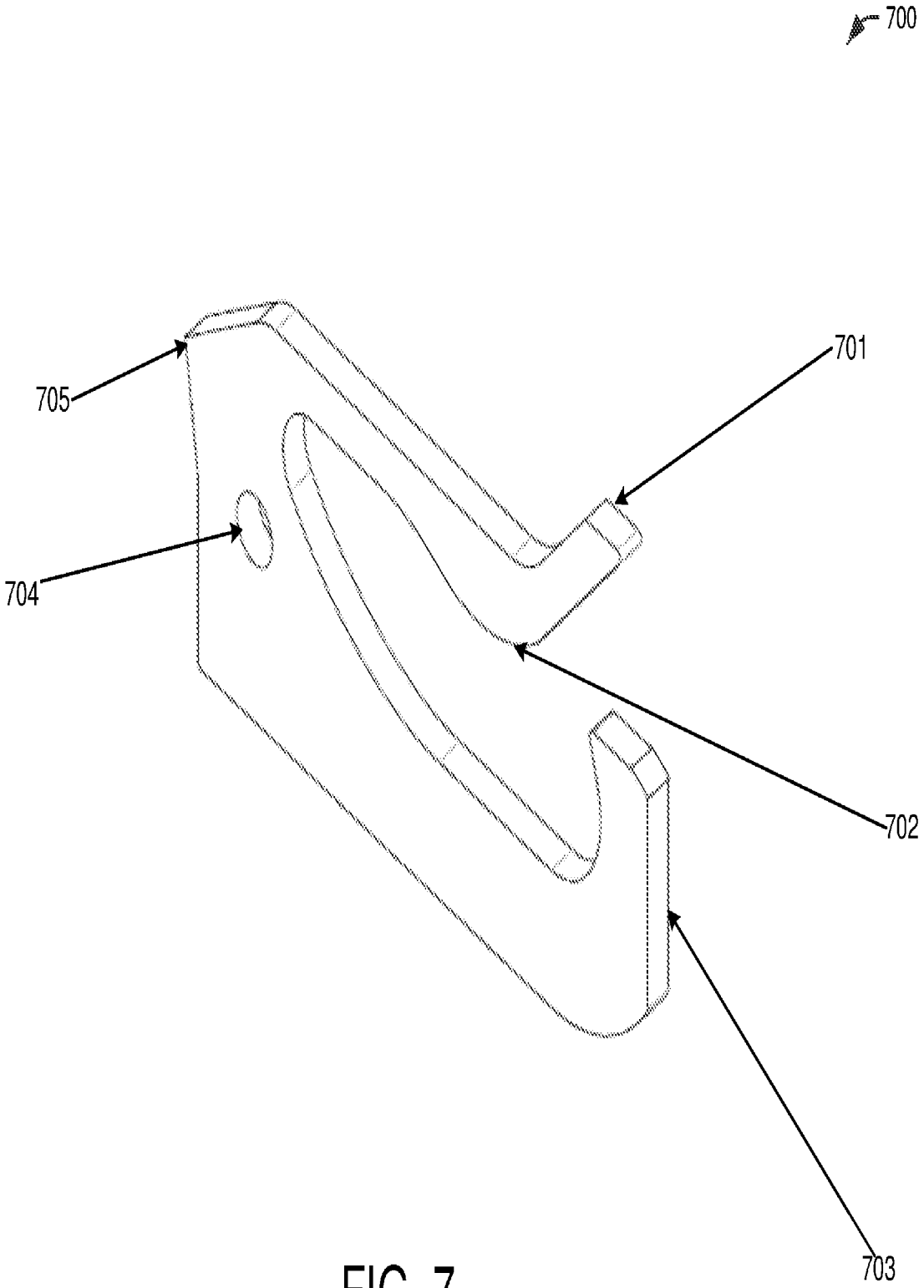
FIG. 7 depicts an angled perspective view of an example seismic hook, according to one example embodiment.

FIG. 7 depicts an angled perspective view of an example stop device including a seismic hook portion of a C-shaped plate including an L-shaped body with a lip, according to one example embodiment. The stop device can be a seismic hook 700 can include backing 705, pivot hole 704, elongated part 701, curve 702, and L-shaped body 703. The curve 703 may be machined in such a way that the internal concave curvature modifies the trajectory of the pin during high speed, and prevents or otherwise inhibits the pin from exiting through the L-shaped body 702 (the retaining part of the hook).

Figure 8:
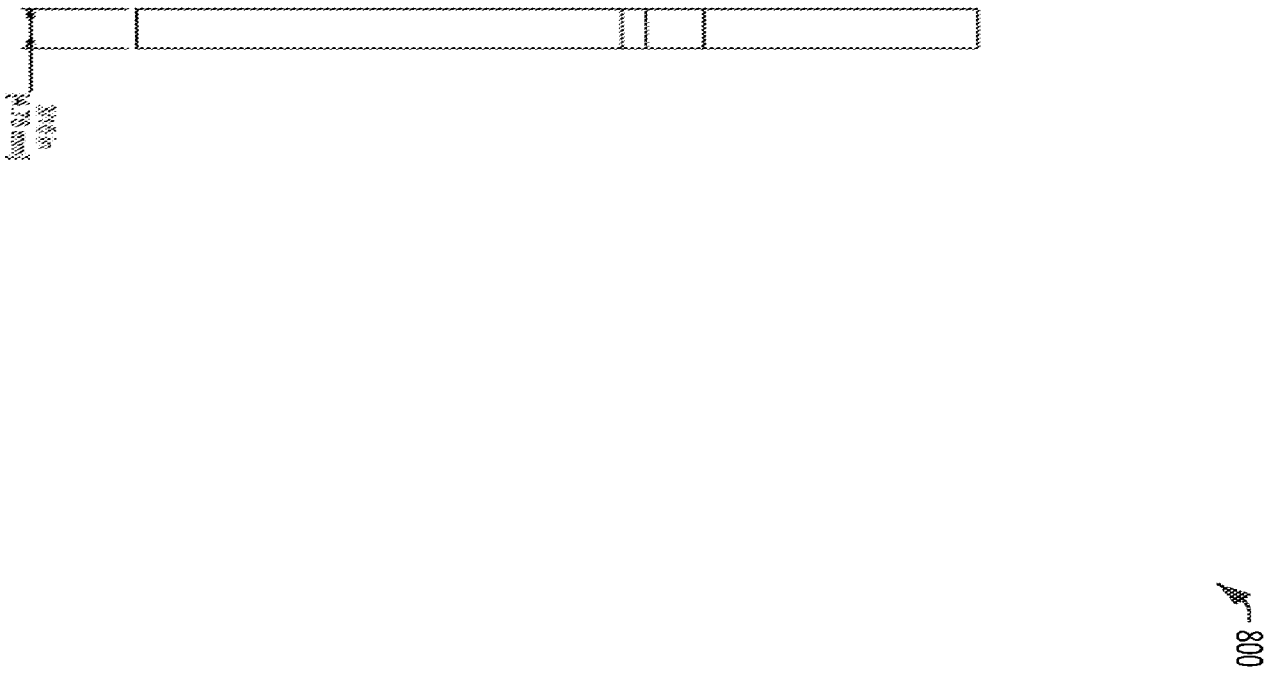
FIG. 8 depicts a front perspective view of an example seismic hook, according to one example embodiment.

FIG. 8 depicts a front perspective view of an example stop device including a seismic hook portion of a C-shaped plate including an L-shaped body with a lip, according to one example embodiment. In some embodiments, seismic hook can be a width of 3/16 inches (4.76 millimeters).

Figure 9A:
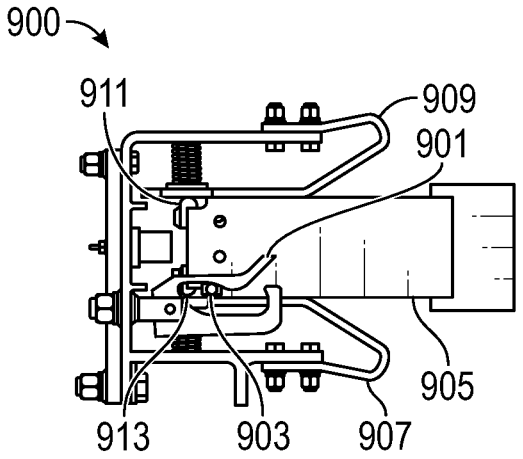
FIGS. 9A-9E depict a side perspective view of a circuit disconnect apparatus, according to one example embodiment.
Figure 9B:
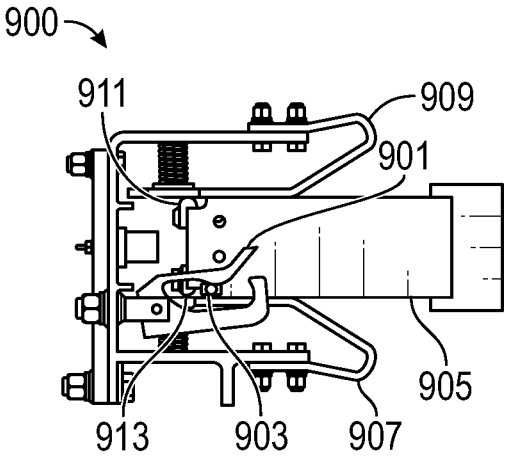

FIGS. 9A-9E depict a side perspective view of a circuit disconnect apparatus, according to one example embodiment. FIGS. 9A-9E may illustrate a slow or normal disconnect process. In FIG. 9A the circuit disconnect apparatus may be in an initial stage of a slow or normal disconnect operation. The circuit disconnect apparatus can include a catch device such as a movable blade plate 905 that is mounted to first conductors 911 and 913 (pivot part of the circuit) which can be in contact with conductors 907 and 909 of a second conductor circuit (guide of the jaw part of the circuit). The catch device can include a movable blade plate and a pin. The circuit disconnect apparatus also can include a stop device such as a seismic hook 901 and pin 903 mounted to a portion of the movable blade plate. The pin 903 can be contact with the inside of the seismic hook 901. After an intended disconnect operation is initiated the movable blade plate 905 can be retracted away from the seismic hook, and the pin 903 moves along the elongated portion of the seismic hook 901 at a first speed until the pin reaches a curve in the seismic hook as illustrated in FIG. 9B.

The catch device can freely move from a first position to a second position along a predetermined first path at a speed of movement below a limiting speed. The catch device can move along a predetermined second path for a speed of movement above the limiting speed. As the catch device moves along the predetermined second path, the catch device engages a stop device (not shown), thereby preventing the circuit disconnect apparatus from disconnecting.

The pin, or first mass, can be guided along the predetermined first path, including a curved path, by a guiding force, and when the inertial force, of the catch device moving along the curved path, exceeds a guiding force, the catch device deviates from the curved path and follows the predetermined second path. The guiding force can be gravity, a controlled force, a controlled and intended force, and/or a spring force. The inertial force can include a seismic event, an unexpected disconnect event, or an unintended disconnect event. A spring force can be generated by a spring, a retractable roller with a spring, or a cable or wire in combination with a spring and/or a retractable roller with a spring.

Figure 9C:
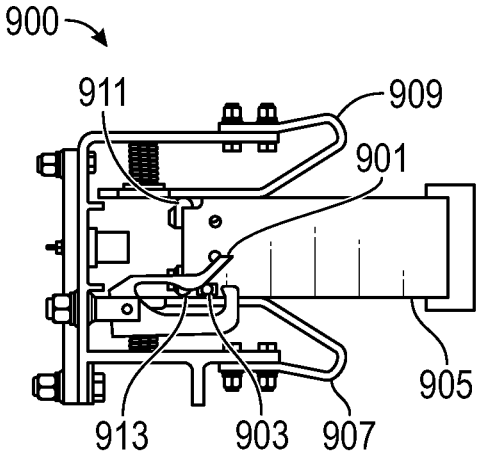
Figure 9D:
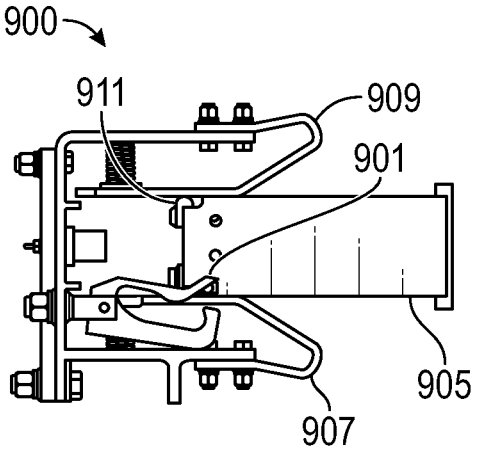
Figure 9E:
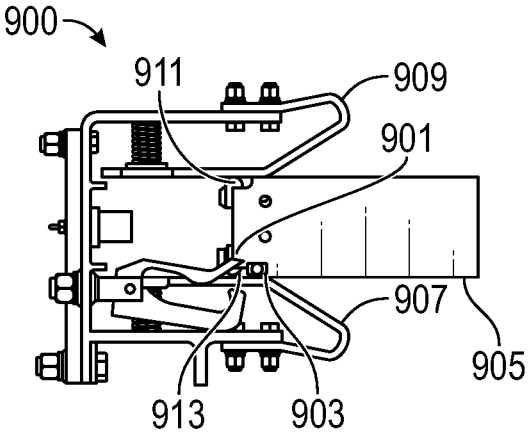

Once the pin 903 comes into contact with the curve of seismic hook 901, the pin can traverse the elongated portion of the seismic hook thereby distorting or slowing the velocity at which the movable blade plate 905 is moving. After the pin 903 passes the curve of the seismic hook 901, as shown in FIG. 9C the pin 903 may continue to traverse the inside of the elongated part of the seismic hook 901 as show in FIG. 9D until the pin is completely disengaged from the seismic hook 901 as shown in FIG. 9E. At this point the pin 903 is no longer in contact with the seismic hook 901 and is not in the open portion of the seismic hook between the elongated part of the seismic hook 901 and the L-shaped body with a lip.

Figure 10A:
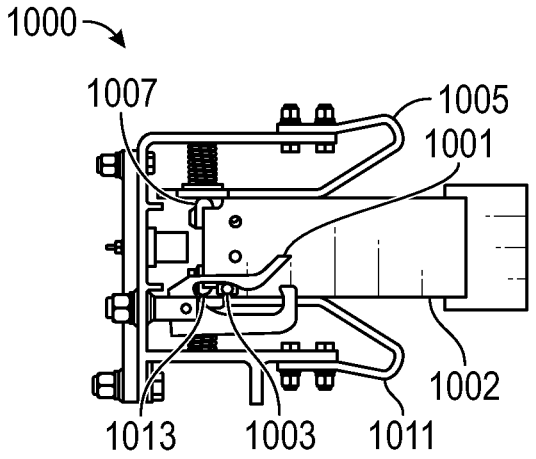
FIGS. 10A-10E depict another side perspective view of a circuit disconnect apparatus, according to one example embodiment.
Figure 10B:
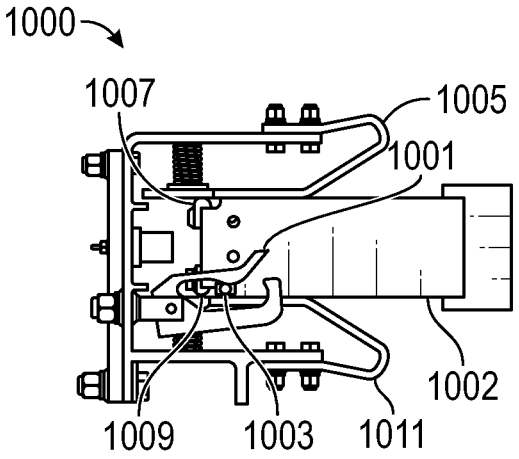
Figure 10C:
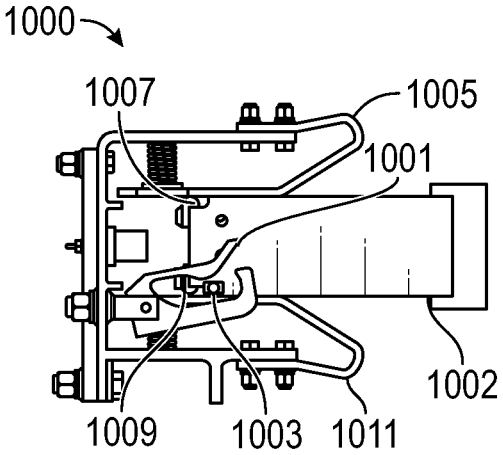

FIGS. 10A-10E depict another side perspective view of a circuit disconnect apparatus, according to one example embodiment. FIGS. 10A-10E may illustrate a fast, unintended, or unexpected disconnect process. In FIG. 10A the circuit disconnect apparatus may be in an initial stage of an unexpected or unintended disconnect operation. The unexpected or unintended disconnect operation may result from seismic activity such as an earthquake, or a short circuit. The circuit disconnect apparatus can include a catch device such as a movable blade plate 1002 that is mounted to first conductors 1007 and 1009 (pivot part of the circuit) which can be in contact with conductors 1005 and 1011 of a second conductor circuit (guide of the jaw part of the circuit). The catch device can include a movable blade plate and a pin. The circuit disconnect apparatus also can include a stop device such as a seismic hook 1001 and pin 1003 mounted to a portion of the movable blade plate. The pin 1003 can be in contact with the inside of the seismic hook 1001. After an intended disconnect operation is initiated the movable blade plate 1002 can be retracted away from the seismic hook, and the pin 1003 can move along the elongated portion of the seismic hook 1001 at a velocity that is greater than the velocity at which the movable blade plate 1002 would move after a normal disconnect operation. The movable plate can continue to traverse the elongated part of the seismic hook 1001 until the pin reaches a curve in the seismic hook as illustrated in FIG. 10B.

The catch device can freely move from a first position to a second position along a predetermined first path at a speed of movement below a limiting speed. The catch device can move along a predetermined second path for a speed of movement above the limiting speed. As the catch device moves along the predetermined second path, the catch device engages a stop device (not shown), thereby preventing the circuit disconnect apparatus from disconnecting.

The pin, or first mass, can be guided along the predetermined first path, including a curved path, by a guiding force, and when the inertial force, of the catch device moving along the curved path, exceeds a guiding force, the catch device deviates from the curved path and follows the predetermined second path. The guiding force can be gravity, a controlled force, a controlled and intended force, and/or a spring force. The inertial force can include a seismic event, an unexpected disconnect event, or an unintended disconnect event. A spring force can be generated by a spring, a retractable roller with a spring, or a cable or wire in combination with a spring and/or a retractable roller with a spring.

Figure 10D:
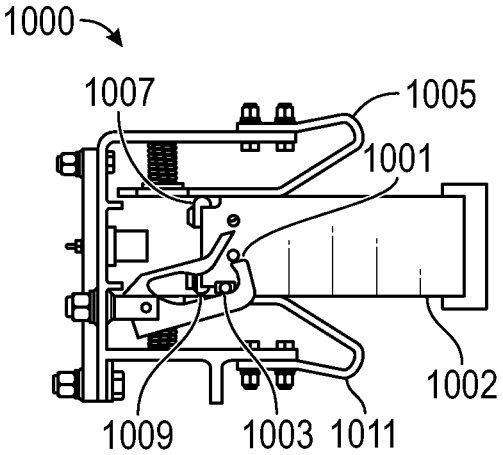
Figure 10E:
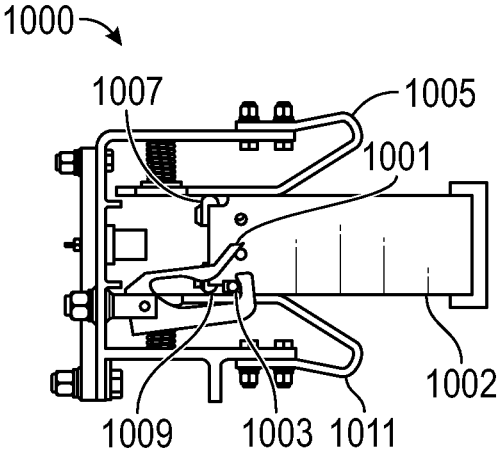

Once the pin 1003 comes into contact with the curve of seismic hook 1001, the pin can traverse the elongated portion of the seismic hook until the pin reaches a point anywhere on the curve after which the pin can pass through the opening of the seismic hook as shown in FIG. 10 and land on the L-shaped body of the seismic hook 1001 as shown in FIG. 10D. Because of the velocity at which the pin 1003 is traveling coupled with the moment of inertia of the seismic hook 1001 and the curve of the seismic hook 1001, the pin 1003 may not traverse the inside of the elongated part of the seismic hook 1001, but rather disengage completely from the seismic hook 1001 and land at a location within the lip at an end portion of the L-shaped body. This is done to ensure that there is no abrupt change in the flow of current between the conductors 1007 and 1009 and the conductors 1005 and 1011, to prevent or otherwise minimize the chance of arcing. This can be especially important when there is a seismic event, unexpected disconnect event, unintended disconnect event, or short-circuit that can cause the movable blade plate 1002 to become completely disengaged from the jaw part of the circuit. After the pin 1003 passes through the opening of the seismic hook 1001 and lands on the L-shaped body, the pin 1003 can stop moving after the pin comes into contact with the lip of the L-shaped body as shown in FIG. 10E.

Figure 11:
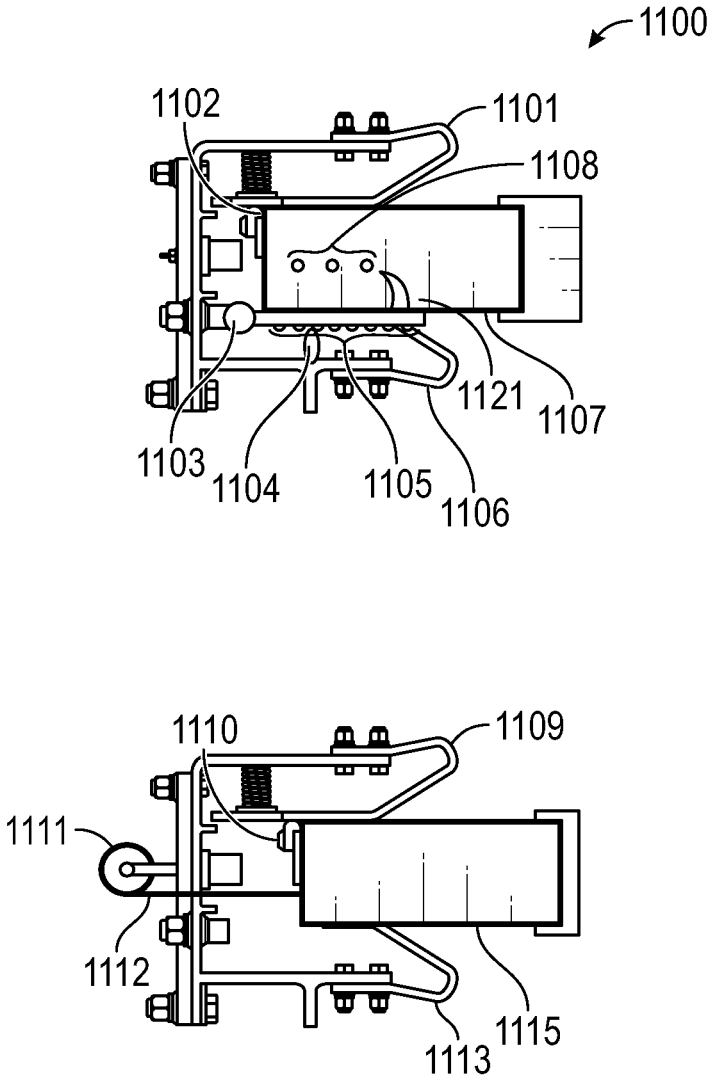
FIG. 11 depicts a side perspective view of an alternative circuit disconnect apparatus, according to one example embodiment.

FIG. 11 depicts a side perspective view of another embodiment of a circuit disconnect apparatus, according to one example embodiment. In some embodiments, there can be a circuit disconnect apparatus including a catch device such as a movable blade plate 1107 mounted to a first conductor 1102 of a circuit, wherein the movable blade plate 1107 includes an external surface, and a connecting device includes a mount 1103, a stop device such as a hook 1121, and ridges 1105 mounted to a second conduct of the circuit. The catch device can include a movable blade plate and a pin. The apparatus can also include raised stoppers 1108 on the surface of the movable blade plate 1107. The apparatus can also include a mechanism operable to provide contact between the movable blade plate 1107 and the connecting device. When a disconnect operation is initiated, the movable blade plate 1107 can be retracted away from the mount 1103, wherein the connecting device permits the movable blade plate 1107 to retract away from the mount 1103 in a controlled manner when the hook 1121 engages the raised one or more of the stoppers 1108. One or more of the ridges 1105 may be engaged by the raised nob 1104. This embodiment can prevent the conductor 1102 from becoming disengaged from the conductor 1101 in the event of an unexpected disconnection event.

The catch device can freely move from a first position to a second position along a predetermined first path at a speed of movement below a limiting speed. The catch device can move along a predetermined second path for a speed of movement above the limiting speed. As the catch device moves along the predetermined second path, the catch device engages a stop device, thereby preventing the circuit disconnect apparatus from disconnecting.

In some embodiments, there can be a circuit disconnect apparatus which includes a catch device such as a movable blade plate 1115 mounted to a first conductor 1102 of a circuit, wherein the catch device includes an external surface, a connecting device (e.g., centrifugal roller lock-up 1111) mounted to a second conductor of the circuit, and a mechanism (e.g., band or chain 1112) operable to provide contact between the movable blade plate 1115 and the connecting device when the apparatus is in a closed position. The catch device can include a movable blade plate and a pin. When a disconnect operation is initiated for the apparatus, the movable blade plate 1115 can be retracted away from the connecting device, wherein the mechanism permits the movable blade plate 1115 to retract away from the connecting device until there is no contact between the movable blade plate 1115 and the connecting device. When an unexpected or unintended disconnect event occurs, and the apparatus is in a closed position, the mechanism can inhibit the movable blade plate 1115 from retracting away from the connecting device and can maintain contact between the movable blade plate 1115 and the connecting device.

The catch device can freely move from a first position to a second position along a predetermined first path at a speed of movement below a limiting speed. The catch device can move along a predetermined second path for a speed of movement above the limiting speed. As the catch device moves along the predetermined second path, the catch device engages a stop device, thereby preventing the circuit disconnect apparatus from disconnecting.

In some embodiments, the mechanism includes at least one cable (e.g., band or chain 1112) and a retractable roller (e.g., centrifugal roller lock-up 1111), wherein the at least one cable connects between the movable blade plate 1115 and the connecting device. When an unexpected or unintended disconnect event occurs, and the apparatus is in a closed position, the retractable roller can inhibit extension of the at least one cable. The at least one cable can be an insulator material if the cable is used in a high voltage application, and the cable can withstand high dielectric stresses. The second conductor of the circuit is a guide of the jaw part of the circuit.

This embodiment can prevent the conductor 1110 from becoming disengaged from the conductor 1109 in the event of an unexpected or unintended disconnection event.

In one embodiment, a method for providing a circuit disconnect apparatus can be provided. The method can include providing a movable blade plate mounted to a first conductor of the circuit, wherein the movable blade plate includes a pin mounted to a portion of the movable blade plate. The method can also include providing a pivot bar mounted in a stationary position to a second conductor of the circuit. The method can further include providing a C-shaped plate mounted to the fixed pivot bar, wherein the C-shaped plate rotates about an axis with respect to the pivot bar, the C-shaped plate having an elongated portion connected to a hook portion with an opening between the elongated portion and the hook portion. The method can also include, when the apparatus is in a closed position, the movable blade plate moves adjacent the C-shaped plate, wherein the pin moves within the opening of the C-shaped plate, and the pin is in contact with the C-shaped plate. The method can also include, when a disconnect operation is initiated for the apparatus, the movable blade plate is retracted away from the C-shaped plate, wherein the pin moves along the elongated portion until the pin disengages contact with the C-shaped plate and is no longer within the opening of the C-shaped plate. The method can further include, when an unexpected disconnect event occurs, and the apparatus is initially in a closed position, the movable pin is retained within the opening of the C-shaped plate and the pin remains in contact with either the elongated portion or the hook portion of the C-shaped plate.

In at least one embodiment, the hook portion can include an L-shaped body with a lip at an end portion of the L-shaped body, wherein when the pin moves along the L-shaped body and engages the lip, the pin is maintained in contact with the lip of the C-shaped plate.

In at least one embodiment, the elongated portion can include an outward projection at an end portion of the hook portion wherein during the disconnect operation, the pin moves along the elongated portion and along the outward projection until the pin is no longer in contact with the elongated portion of the C-shaped plate.

In at least one embodiment, when closing the apparatus, the pin of the movable blade plate engages the C-shaped plate and the C-shaped plate rotates about the axis with respect to the pivot bar as the pin is in contact with the elongated portion or the hook portion of the C-shaped plate.

In at least one embodiment, when the disconnect operation is initiated for the apparatus, or when an unexpected disconnect event occurs, and the apparatus is in a closed position, the C-shaped plate rotates about the axis with respect to the pivot bar as the pin is in contact with the elongated portion or the hook portion of the C-shaped plate.

In at least one embodiment, when a disconnect operation is initiated for the apparatus, and the apparatus is in a closed position, the C-shaped plate rotates about the axis with respect to the pivot bar as the pin is in contact with the elongated portion of the hook portion until it reaches a curve in the elongated portion and then moves across the opening to the hook portion of the C-shaped plate.

In at least one embodiment, the disconnect operation is initiated when a velocity of the movable blade exceeds a predefined velocity.

In at least one embodiment, when the pin moves along the L-shaped body and engages the lip, the pin is maintained in contact with the lip of the C-shaped plate.

In at least one embodiment, the disconnect operation is initiated when the movable blade plate exceeds a predefined velocity.

In one embodiment, a method for using a circuit disconnect apparatus can be provided. The method can include manipulating a movable blade plate mounted to a first conductor of a circuit, wherein the movable blade plate includes a pin mounted to a portion of the movable blade plate, towards a pivot bar mounted in a stationary position to a second conductor of the circuit, wherein a C-shaped plate is mounted to the pivot bar. The method can include, as the movable blade moves towards the pivot bar, rotating the C-shaped plate about an axis with respect to the pivot bar, the C-shaped plate including an elongated portion connected to a hook portion with an opening between the elongated portion and the hook portion. The method can further include, when the apparatus is in a closed position, maintaining contact between the movable blade plate and the C-shape plate, wherein the pin moves within the opening of the C-shaped plate, and the pin is in contact with the C-shaped plate. The method can further include, when an intended disconnect operation is initiated for the apparatus, retracting the movable blade plate away from the C-shaped plate, wherein the pin moves along the elongated portion until the pin disengages contact with the C-shaped plate and is no longer within the opening of the C-shaped plate. The method can also include, when an unexpected disconnect event occurs and the apparatus is in the closed position, retaining the pin within the opening of the C-shaped plate and the pin remains in contact with either the elongated portion or the hook portion of the C-shaped plate.

In at least one embodiment, the hook portion includes an L-shaped body with a lip at an end portion of the L-shaped body, wherein when the pin moves along the L-shaped body and engages the lip, and the method of use can further include maintaining the pin in contact with the lip of the C-shaped plate, wherein the elongated portion includes an outward projection at an end portion of the hook portion wherein during the disconnect operation, and the method can further include moving the pin along the elongated portion and along the outward projection until the pin is no longer in contact with the elongated portion of the C-shaped plate.

In at least one embodiment, the method can include, when closing the apparatus, engaging the pin of the movable blade plate by the C-shaped plate and rotating the C-shaped plate about the axis with respect to the pivot bar as the pin is in contact with the elongated portion or the hook portion of the C-shaped plate; and wherein when the disconnect operation is initiated for the apparatus, or when an unexpected disconnect event occurs, and the apparatus is in a closed position, rotating the C-shaped plate about the axis with respect to the pivot bar as the pin is in contact with the elongated portion or the hook portion of the C-shaped plate.

It should be noted that embodiments of the inertial short circuit and seismic hook are not limited to high voltage equipment. It is equally applicable in lower voltage equipment in which a switch is required to maintain a connection between two circuits separated by a distance, and that can be separated under normal operations, and separated as a result of unintended disconnection events.

That which is claimed:

1. A method for providing a circuit disconnect apparatus, the method comprising:

providing a movable blade plate mounted to a first conductor of the circuit, wherein the movable blade plate includes a pin mounted to a portion of the movable blade plate;

providing a pivot bar mounted in a stationary position to a second conductor of the circuit;

providing a C-shaped plate mounted to the fixed pivot bar, wherein the C-shaped plate rotates about an axis with respect to the pivot bar, the C-shaped plate having an elongated portion connected to a hook portion with an opening between the elongated portion and the hook portion;

when the apparatus is in a closed position, the movable blade plate moves adjacent the C-shaped plate, wherein the pin moves within the opening of the C-shaped plate, and the pin is in contact with the C-shaped plate;

when a disconnect operation is initiated for the apparatus, the movable blade plate is retracted away from the C-shaped plate, wherein the pin moves along the elongated portion until the pin disengages contact with the C-shaped plate and is no longer within the opening of the C-shaped plate; and when an unexpected disconnect event occurs, and the apparatus is initially in a closed position, the movable pin is retained within the opening of the C-shaped plate and the pin remains in contact with either the elongated portion or the hook portion of the C-shaped plate.

2. The method of claim 1, wherein the hook portion comprises an L-shaped body with a lip at an end portion of the L-shaped body, wherein when the pin moves along the L-shaped body and engages the lip, the pin is maintained in contact with the lip of the C-shaped plate.

3. The method of claim 1, wherein the elongated portion can include an outward projection at an end portion of the hook portion wherein during the disconnect operation, the pin moves along the elongated portion and along the outward projection until the pin is no longer in contact with the elongated portion of the C-shaped plate.

4. The method of claim 1, wherein when closing the apparatus, the pin of the movable blade plate engages the C-shaped plate and the C-shaped plate rotates about the axis with respect to the pivot bar as the pin is in contact with the elongated portion or the hook portion of the C-shaped plate.

5. The method of claim 1, wherein when the disconnect operation is initiated for the apparatus, or when an unexpected disconnect event occurs, and the apparatus is in a closed position, the C-shaped plate rotates about the axis with respect to the pivot bar as the pin is in contact with the elongated portion or the hook portion of the C-shaped plate.

6. The method of claim 1, wherein when a disconnect operation is initiated for the apparatus, and the apparatus is in a closed position, the C-shaped plate rotates about the axis with respect to the pivot bar as the pin is in contact with the elongated portion of the hook portion until it reaches a curve in the elongated portion and then moves across the opening to the hook portion of the C-shaped plate.

7. The method of claim 1, wherein the disconnect operation is initiated when a velocity of the movable blade exceeds a predefined velocity.

8. The method of claim 1, wherein when the pin moves along the L-shaped body and engages the lip, the pin is maintained in contact with the lip of the C-shaped plate.

9. The method of claim 1, wherein the disconnect operation is initiated when the movable blade plate exceeds a predefined velocity.

10. A circuit disconnect apparatus comprising:

a movable blade plate mounted to a first conductor of a circuit, wherein the movable blade plate includes an external surface, the moveable blade plate including one or more stoppers;

a connecting device mounted to a second conductor of the circuit, the connecting device including a hook;

a mechanism operable to provide contact between the movable blade plate and the connecting device when the apparatus is in a closed position;

wherein when a disconnect operation is initiated for the apparatus, the movable blade plate is retracted away from the connecting device, wherein the mechanism permits the movable blade plate to retract away from the connecting device until there is no contact between the movable blade plate and the connecting device; and wherein when an unexpected disconnect event occurs, and the apparatus is in a closed position, the mechanism inhibits the movable blade plate from retracting away from the connecting device and maintains contact between the movable blade plate and the connecting device.

11. A method for using a circuit disconnect apparatus, the method comprising:

manipulating a movable blade plate mounted to a first conductor of a circuit, wherein the movable blade plate includes a pin mounted to a portion of the movable blade plate, towards a pivot bar mounted in a stationary position to a second conductor of the circuit, wherein a C-shaped plate is mounted to the pivot bar;

as the movable blade moves towards the pivot bar, rotating the C-shaped plate about an axis with respect to the pivot bar, the C-shaped plate including an elongated portion connected to a hook portion with an opening between the elongated portion and the hook portion;

when the apparatus is in a closed position, maintaining contact between the movable blade plate and the C-shape plate, wherein the pin moves within the opening of the C-shaped plate, and the pin is in contact with the C-shaped plate;

when an intended disconnect operation is initiated for the apparatus, retracting the movable blade plate away from the C-shaped plate, wherein the pin moves along the elongated portion until the pin disengages contact with the C-shaped plate and is no longer within the opening of the C-shaped plate; and when an unexpected disconnect event occurs and the apparatus is in the closed position, retaining the pin within the opening of the C-shaped plate and the pin remains in contact with either the elongated portion or the hook portion of the C-shaped plate.

12. The method of claim 11, wherein the hook portion includes an L-shaped body with a lip at an end portion of the L-shaped body, wherein when the pin moves along the L-shaped body and engages the lip, the method further comprises:

maintaining the pin in contact with the lip of the C-shaped plate, wherein the elongated portion includes an outward projection at an end portion of the hook portion wherein during the disconnect operation; and moving the pin along the elongated portion and along the outward projection until the pin is no longer in contact with the elongated portion of the C-shaped plate.

13. The method of claim 11, wherein when closing the apparatus, engaging the pin of the movable blade plate by the C-shaped plate and rotating the C-shaped plate about the axis with respect to the pivot bar as the pin is in contact with the elongated portion or the hook portion of the C-shaped plate; and wherein when the disconnect operation is initiated for the apparatus, or when an unexpected disconnect event occurs, and the apparatus is in a closed position, rotating the C-shaped plate about the axis with respect to the pivot bar as the pin is in contact with the elongated portion or the hook portion of the C-shaped plate.

* * * * *